US007957840B2

(12) United States Patent
Sangenya et al.

(10) Patent No.: US 7,957,840 B2
(45) Date of Patent: Jun. 7, 2011

(54) CONTROL APPARATUS AND CONTROL METHOD FOR MULTI-ROOM AIR CONDITIONER

(75) Inventors: Hideki Sangenya, Shiga (JP); Takeshi Kitagawa, Shiga (JP)

(73) Assignee: Daikin Industries, Ltd., Osaka (JP)

( * ) Notice: Subject to any disclaimer, the term of this patent is extended or adjusted under 35 U.S.C. 154(b) by 350 days.

(21) Appl. No.: 12/294,580

(22) PCT Filed: Mar. 28, 2007

(86) PCT No.: PCT/JP2007/056682

§ 371 (c)(1),
(2), (4) Date: Sep. 25, 2008

(87) PCT Pub. No.: WO2007/114178

PCT Pub. Date: Oct. 11, 2007

(65) Prior Publication Data

US 2009/0138127 A1 May 28, 2009

(30) Foreign Application Priority Data

Mar. 31, 2006 (JP) ..... 2006-099388

(51) Int. Cl.
*G06F 19/00* (2006.01)

(52) U.S. Cl. ..... 700/277; 700/280

(58) Field of Classification Search ..... 700/280, 700/277; 62/515, 428, 94, 271
See application file for complete search history.

(56) References Cited

U.S. PATENT DOCUMENTS 6,038,873 A * 3/2000 Koo ..... 62/196.4
2005/0172304 A1 * 8/2005 Tavares et al. ..... 719/318

FOREIGN PATENT DOCUMENTS

JP H02-106645 A 4/1990
JP H07-103546 A 4/1995
JP H08-247561 A 9/1996
JP 2005-134082 A 5/2005
JP 2005-180842 A 7/2005

* cited by examiner

*Primary Examiner* — Kidest Bahta
(74) *Attorney, Agent, or Firm* — Global IP Counselors

(57) ABSTRACT

A heat source side controller of an air conditioner has an operating mode allocator and an operating mode setter. The air conditioner has a heat source unit and a plurality of room units. The heat source unit can be switched among a plurality of operating modes having different noise-reduction levels. The operating mode allocator allocates one operating mode to each of the operating room units. The operating mode setter sets the heat source unit to one operating mode from among the plurality of operating modes on the basis of the operating modes allocated by the operating mode allocator to each of the operating room units. In cases in which a specific operating mode is allocated to all of the operating room units, the operating mode setter sets the heat source unit to the specific operating mode.

16 Claims, 6 Drawing Sheets

| OPERATING MODE | UPPER LIMIT OF OPERATING FREQUENCY OF COMPRESSOR | UPPER LIMIT OF ROTATIONAL SPEED OF HEAT SOURCE-SIDE FAN |
|---|---|---|
| NOISE-REDUCTION OPERATING MODE I | CLOSE TO RATED | CLOSE TO RATED |
| NOISE-REDUCTION OPERATING MODE II | LOWERED BY ABOUT 3 dB | LOWERED BY ABOUT 3 dB |
| NOISE-REDUCTION OPERATING MODE III | LOWERED BY ABOUT 5 dB | LOWERED BY ABOUT 5 dB |

FIG. 4

CONTROL APPARATUS AND CONTROL METHOD FOR MULTI-ROOM AIR CONDITIONER

CROSS-REFERENCE TO RELATED APPLICATIONS

This U.S. National stage application claims priority under 35 U.S.C. §119(a) to Japanese Patent Application No. 2006-099388, filed in Japan on Mar. 31, 2006, the entire contents of which are hereby incorporated herein by reference.

TECHNICAL FIELD

The present invention relates to a control apparatus and a control method for a multi-room air conditioner having a heat source unit that can be switched among a plurality of operating modes of different reduced-noise levels.

BACKGROUND ART

A heat source unit of an air conditioner is usually equipped with a compressor, a fan, or another such electrical device that produces comparatively loud operating sounds, and such operating sounds are sometimes the cause of noise. In addition to a regular operating mode, the heat source unit disclosed in Japanese Laid-open Patent Application No. 7-103546 is provided with a reduced-noise operating mode in which a reduced-noise operation is achieved by imposing an appropriate restriction on the upper limit of the operating frequency of the compressor or the rotational speed of the fan.

SUMMARY OF THE INVENTION

Problems the Invention is Intended to Solve

There is a difference in the level of noise produced by the operation of the heat source unit between a room in which the heat source unit is placed immediately outside a window, and a room located in a position comparatively distanced from the heat source unit. Thus, despite relying on the same heat source unit, each room is affected differently. Furthermore, since rooms have individual differences, each room will presumably have a different requirement for operating the heat source unit in regular operating mode or reduced-noise operating mode, or for operating the heat source at any reduced-noise level in cases in which the reduced-noise operating mode is provided with multiple reduced-noise levels.

However, in the case of a multi-room air conditioner, there is a plurality of rooms that are to be air conditioned by one heat source unit, and the operating mode setting used for the heat source unit cannot be varied with each room. Even with the multi-type air conditioner disclosed in Japanese Laid-open Patent Application No. 7-103546, whether or not to use reduced-noise operating mode is forcibly determined according to the operating time period, and the air conditioner is not configured to make allowances for the requirements of each room.

An object of the present invention is to provide a multi-room air conditioner having a heat source unit that can be switched among a plurality of operating modes of different reduced-noise levels, wherein an optimal noise-reduction operation can be selected by adjusting the requirements from the rooms when one operating mode is selected from a plurality of operating modes.

Means for Solving these Problems

The control apparatus for a multi-room air conditioner according to a first aspect comprises an operating mode allocator and an operating mode setter. The multi-room air conditioner has a heat source unit, and a plurality of conditioning units connected to the heat source unit via a refrigerant communication tube. The heat source unit can be switched among a plurality of operating modes having different noise-reduction levels. The plurality of conditioning units is distributed among a plurality of rooms. The operating mode allocator allocates one operating mode from among the plurality of operating modes to each of the operating conditioning units of the plurality of conditioning units. The operating mode setter sets the heat source unit to one operating mode from among the plurality of operating modes on the basis of the operating modes allocated by the operating mode allocator to each of the operating conditioning units. The operating mode setter sets the heat source unit to a specific operating mode under a first condition. The term "first condition" refers to a state in which a specific operating mode from among the plurality of operating modes is allocated to all of the operating conditioning units.

The heat source unit of the multi-room air conditioner is herein provided with a plurality of operating modes having different noise-reduction levels. When one operating mode is specifically selected from the plurality of operating modes while the multi-room air conditioner is operating, first, one operating mode from among the plurality of operating modes is allocated to each of the operating conditioning units. Then, as a result of allocating an operating mode to each of the conditioning units in this manner, in cases in which the same specific operating mode has been allocated to all of the operating conditioning units, that specific operating mode is the operating mode for the heat source unit. Thus, the operating mode of the heat source unit herein is determined based on the operating mode allocated to the conditioning units. Consequently, in the multi-room air conditioner having a heat source unit that can be switched among a plurality of operating modes having different noise-reduction levels, the requirements from the rooms can be adjusted when one operating mode is selected from the plurality of operating modes, and an optimal noise-reduction operation can be achieved.

The control apparatus for a multi-room air conditioner according to a second aspect is the control apparatus for a multi-room air conditioner according to the first aspect, wherein the plurality of operating modes includes a regular operating mode, and a plurality of noise-reduction operating modes in which the noise-reduction levels are progressively higher than in the regular operating mode.

The heat source unit of the multi-room air conditioner is herein provided with a regular operating mode and multiple levels of noise-reduction operating modes. Consequently, it is possible to perform more attuned noise-reduction operation suited to the situation.

The control apparatus for a multi-room air conditioner according to a third aspect is the control apparatus for a multi-room air conditioner according to the first or second aspect, wherein the multi-room air conditioner also has an operating mode selector. The operating mode selector allows the user to select one operating mode from among the plurality of operating modes via the operating conditioning units. The operating mode allocator allocates one operating mode from among the plurality of operating modes to each of the operating conditioning units on the basis of the operating mode selected by the user via the operating mode selector.

Users in the rooms in which the conditioning units are installed can request an operating mode via all of the operating conditioning units. Consequently, requests from the rooms can be collected and adjusted.

The control apparatus for a multi-room air conditioner according to a fourth aspect is the control apparatus for a multi-room air conditioner according to the second aspect, wherein the heat source unit has a heat exchanger and a heat source side fan. The heat source side fan sends air to the heat exchanger. Restrictions that differ according to the plurality of operating modes are imposed on the rotational speed of the heat source side fan.

Different restrictions are imposed on the operating frequency of the heat source side fan in accordance with the operating mode. The heat source unit can thereby be made to operate in a plurality of operating modes having different noise-reduction levels.

The control apparatus for a multi-room air conditioner according to a fifth aspect is the control apparatus for a multi-room air conditioner according to the second or fourth aspect, wherein the heat source unit has a compressor. Restrictions that differ according to the plurality of operating modes are imposed on the operating frequency of the compressor.

Different restrictions are imposed on the operating frequency of the compressor in accordance with the operating mode. The heat source unit can thereby be made to operate in a plurality of operating modes having different noise-reduction levels.

The control apparatus for a multi-room air conditioner according to a sixth aspect is the control apparatus for a multi-room air conditioner according to any of the first through fifth aspects, wherein the operating mode setter sets the heat source unit to a specific operating mode under a second condition. The term "second condition" refers to a state in which a specific operating mode is allocated to at least one of the operating conditioning units, and all the required performances of the rooms in which the remaining conditioning units of the operating conditioning units are installed are less than a specific value.

Even in cases in which a specific operating mode is allocated to some of the operating conditioning units and another operating mode is allocated to the remaining operating conditioning units, the specific operating mode is set as the operating mode of the heat source unit in the case that a sufficiently low performance is required in all of the rooms containing the conditioning units allocated the other operating mode. Specifically, this is because it is believed that even when the requests in all of the operating conditioning units are not the same, in the case that the required performances of the conditioning units submitting different requests are sufficiently low, there are not likely to be problems with insufficient air conditioning in the rooms even if they have been allocated an operating mode with a high noise-reduction level. Thus, the requests from the rooms can be adjusted more reasonably when one operating mode is selected from among the plurality of operating modes.

The control apparatus for a multi-room air conditioner according to a seventh aspect is the control apparatus for a multi-room air conditioner according to the second, fourth, or fifth aspect, wherein the operating mode setter does not set the heat source unit to an operating mode having a lower noise-reduction level than a specific noise-reduction operating mode under a third condition. The term "third condition" refers to a state in which at least one of the operating conditioning units is allocated either the specific noise-reduction operating mode from among the plurality of noise-reduction operating modes or a noise-reduction operating mode having a higher noise-reduction level than the specific noise-reduction operating mode.

In cases in which a noise-reduction operating mode of a specific noise-reduction level or higher is requested, even if from only one conditioning unit, an operating mode lower than the specific noise-reduction level will not be set as the operating mode of the heat source unit. This is because it is believed that if the noise-reduction operating mode has a noise-reduction level at a certain specific level or lower, there are not likely to be problems with insufficient cooling in any of the rooms even if the noise-reduction operating mode is implemented. Thus, the requests from the rooms can be adjusted more reasonably when one operating mode is selected from among the plurality of operating modes.

The control apparatus for a multi-room air conditioner according to an eighth aspect is the control apparatus for a multi-room air conditioner according to any of the first through fifth aspects, wherein the multi-room air conditioner also has a priority conditioning unit setter. The priority conditioning unit setter accepts settings that prioritize any one of the plurality of conditioning units. The operating mode setter sets the heat source unit to the operating mode allocated to a conditioning unit given a priority setting under a fourth condition. The term "fourth condition" refers to a state in which the conditioning unit given the priority setting via the priority conditioning unit setter is operating.

It is possible to give a conditioning unit a priority setting in which the request from one conditioning unit is given priority over the requests from the other conditioning units.

The control apparatus for a multi-room air conditioner according to a ninth aspect is the control apparatus for a multi-room air conditioner according to the second, fourth, or fifth aspect, wherein the multi-room air conditioner also has a performance priority setter. The performance priority setter accepts settings prioritizing that performance will be ensured in at least one of the plurality of conditioning units. The operating mode setter sets the heat source unit to the regular operating mode under a fifth condition. The term "fifth condition" refers to a state in which the conditioning unit given a priority setting via the performance priority setter is operating.

In cases in which there are conditioning units requesting an operation that prioritizes performance, even if there is only one such conditioning unit, it is possible to suppress noise-reduction operating mode and to allow operation in regular operating mode only.

The control apparatus for a multi-room air conditioner according to a tenth aspect is the control apparatus for a multi-room air conditioner according to the fourth aspect, further comprising a fan rotational speed corrector. The multi-room air conditioner has an outdoor air temperature detection unit. The outdoor air temperature detection unit detects the outdoor air temperature. The fan rotational speed corrector performs a correction so as to increase the rotational speed of the heat source side fan of the heat source unit operating in the noise-reduction operating mode in cases in which the outdoor air temperature detected by the outdoor air temperature detection unit satisfies a specific condition.

Generally, depending on the outdoor air temperature conditions, inconveniences are brought about by the reduction in the rotational speed of the heat source side fan induced by noise-reduction operating mode. The outdoor air temperature is taken into account, and a correction is performed so as to increase the rotational speed of the heat source side fan as necessary. Thus, the problems accompanying the introduction of noise-reduction operating mode are taken into account, and a more comfortable noise-reduction operation is provided.

The control apparatus for a multi-room air conditioner according to an eleventh aspect is the control apparatus for a multi-room air conditioner according to the tenth aspect, wherein the fan rotational speed corrector increases the rotational speed of the heat source side fan in cases in which the outdoor air temperature detected by the outdoor air temperature detection unit is less than a first temperature during the heating operation, or greater than a second temperature above the first temperature during the cooling operation.

Generally, in cases in which a noise-reduction operating mode having a noise-reduction level at a certain constant or greater is implemented during the heating operation under low outdoor air conditions, problems sometimes occur in which the amount of frost deposition in the heat source side heat exchanger increases because the rotational speed of the heat source side fan is reduced, and heating performance is compromised. In cases in which a noise-reduction operating mode having a noise-reduction level at a certain constant or greater is implemented during the cooling operation under high outdoor air conditions, problems sometimes occur in which the electric components in the electric component box inside the heat source unit are not cooled sufficiently because the rotational speed of the heat source side fan is reduced. A correction is performed so as to increase the rotational speed of the heat source side fan in cases in which the outdoor air temperature is too low during the heating operation or too high during the cooling operation while noise-reduction operating mode is being implemented. Therefore, it is possible to prevent problems with increased frost deposition in the heat source side heat exchanger and with insufficient cooling of the electric components.

The control method for a multi-room air conditioner according to the twelfth aspect is a control method for a multi-room air conditioner, and comprises an operating mode allocation step and an operating mode setting step. The multi-room air conditioner has a heat source unit, and a plurality of conditioning units connected to the heat source unit via a refrigerant communication tube. The heat source unit can be switched among a plurality of operating modes having different noise-reduction levels. The plurality of conditioning units is distributed among a plurality of rooms. In the operating mode allocation step, one operating mode from among the plurality of operating modes is allocated to each of the operating conditioning units of the plurality of conditioning units. In the operating mode setting step, the heat source unit is set to one operating mode from among the plurality of operating modes on the basis of the operating modes allocated to each of the operating conditioning units. In the operating mode setting step, the heat source unit is set to the same one operating mode under a first condition. The term "first condition" refers to a state in which the same one operating mode from among the plurality of operating modes is allocated to all of the operating conditioning units.

The heat source unit of the multi-room air conditioner is herein provided with a plurality of operating modes having different noise-reduction levels. When one operating mode is specifically selected from the plurality of operating modes while the multi-room air conditioner is operating, first, one operating mode from among the plurality of operating modes is allocated to each of the operating conditioning units. Then, as a result of allocating an operating mode to each of the conditioning units in this manner, in cases in which the same specific operating mode has been allocated to all of the operating conditioning units, that specific operating mode is the operating mode for the heat source unit. Thus, the operating mode of the heat source unit herein is determined based on the operating mode allocated to the conditioning units. Consequently, in the multi-room air conditioner having a heat source unit that can be switched among a plurality of operating modes having different noise-reduction levels, the requirements from the rooms can be adjusted when one operating mode is selected from the plurality of operating modes, and an optimal noise-reduction operation can be achieved.

Effects of the Invention

With the control apparatus for a multi-room air conditioner according to the first aspect, in a multi-room air conditioner having a heat source unit that can be switched among a plurality of operating modes having different noise-reduction levels, the requirements from the rooms can be adjusted when one operating mode is selected from the plurality of operating modes, and an optimal noise-reduction operation can be achieved.

With the control apparatus for a multi-room air conditioner according to the second aspect, it is possible to perform more attuned noise-reduction operation suited to the situation.

With the control apparatus for a multi-room air conditioner according to the third aspect, the requirements from the rooms can be collected and adjusted.

With the control apparatus for a multi-room air conditioner according to the fourth aspect, the heat source unit can be operated in a plurality of operating modes having different noise-reduction levels.

With the control apparatus for a multi-room air conditioner according to the fifth aspect, the heat source unit can be operated in a plurality of operating modes having different noise-reduction levels.

With the control apparatus for a multi-room air conditioner according to the sixth aspect, the requirements from the rooms can be more reasonably adjusted when one operating mode is selected from the plurality of operating modes.

With the control apparatus for a multi-room air conditioner according to the seventh aspect, the requirements from the rooms can be more reasonably adjusted when one operating mode is selected from the plurality of operating modes.

With the control apparatus for a multi-room air conditioner according to the eighth aspect, precedence settings can be provided to a conditioning unit so that the requirement from one conditioning unit is taken into account with precedence over the requirement from another conditioning unit.

With the control apparatus for a multi-room air conditioner according to the ninth aspect, in cases in which a conditioning unit requires an operation in which performance is a priority, even if only one conditioning unit has this requirement, it is possible to suppress noise-reduction operating mode and to allow only operation in regular operating mode.

With the control apparatus for a multi-room air conditioner according to the tenth aspect, the problems accompanying the introduction of noise-reduction operating mode are taken into account, and a more comfortable noise-reduction operating mode is provided.

With the control apparatus for a multi-room air conditioner according to the eleventh aspect, it is possible to prevent situations in which there is increased frost deposition in the heat source side heat exchanger and insufficient cooling of electric components.

With the control method for a multi-room air conditioner according to the twelfth aspect, in a multi-room air conditioner having a heat source unit that can be switched among a plurality of operating modes having different noise-reduction levels, the requirements from the rooms can be adjusted when one operating mode is selected from the plurality of operating modes, and an optimal noise-reduction operation can be achieved.

BRIEF DESCRIPTION OF THE DRAWINGS

FIG. 4 is a diagram showing the details of the restrictions on the upper limit of the operational frequency of the compressor and the upper limit of the rotational speed of the heat source side fan in three noise-reduction operating modes;

BEST MODE FOR CARRYING OUT DETAILED DESCRIPTION OF THE INVENTION

The control apparatus (heat source side controller 20) and control method for a multi-room air conditioner (air conditioner 1) according to an embodiment of the present invention are described hereinbelow with reference to the diagrams.

<Air Conditioner>

(1) Overall Configuration

Figure 1:
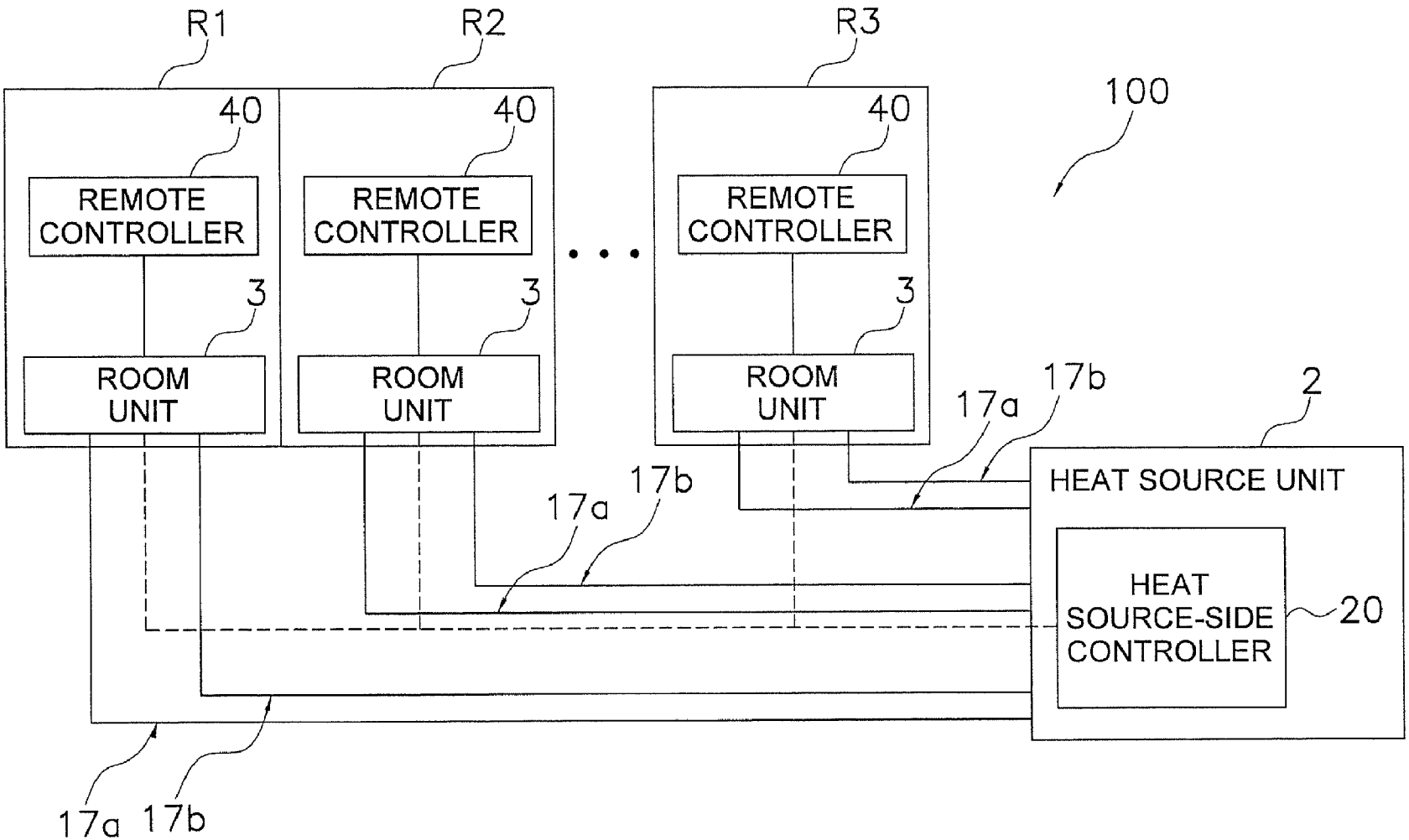
FIG. 1 is a diagram showing the manner in which an air conditioner is placed in a residential building.

FIG. 1 shows the manner in which the air conditioner 1 is placed in a residential building 100. The air conditioner 1 has a configuration in which a plurality of room units 3 disposed in parallel is connected to one heat source unit 2. The plurality of room units 3 is distributed throughout a plurality of rooms R1, R2, . . . , Rn (n is an integer equal to or greater than 2) separated from each other within the residential building 100, and the heat source unit 2 is installed in the side of the structure of the residential building 100 or another such location. The air conditioner 1 is a multi-room air conditioner.

Figure 2:
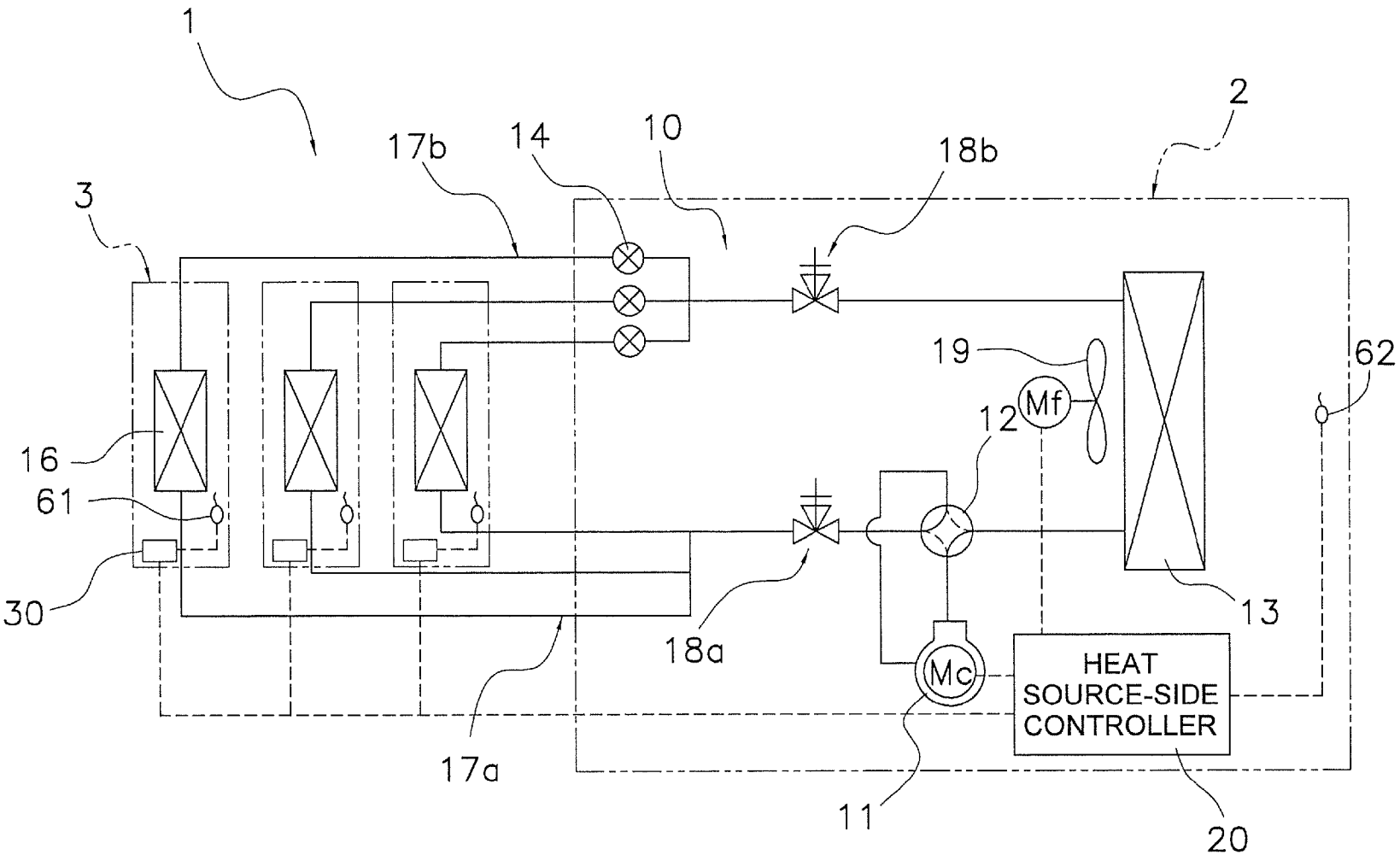
FIG. 2 is a diagram showing the configuration of the refrigerant circuit of the air conditioner.

FIG. 2 shows a refrigerant circuit 10 of the air conditioner 1. The refrigerant circuit 10 of the air conditioner 1 includes mainly a compressor 11, a four-way switching valve 12, a heat source side heat exchanger 13, heat source side expansion valves 14, and room side heat exchangers 16, which are connected in the stated order, forming a vapor compression refrigeration cycle.

The compressor 11, the four-way switching valve 12, the heat source side heat exchanger 13, and the heat source side expansion valves 14 are contained in the heat source unit 2, and the room side heat exchangers 16 are contained in the room units 3. The refrigerant circuit inside the heat source unit 2 and the refrigerant circuits inside the room units 3 are linked by gas refrigerant communication tubes 17*a* and liquid refrigerant communication tubes 17*b*. The heat source unit 2 is also provided with an accumulator and other auxiliary devices, but these devices are not shown in the diagrams.

The refrigerant circuit inside the heat source unit 2 is provided with a gas-side closing valve 18*a* and a liquid-side closing valve 18*b*. The gas-side closing valve 18*a* is disposed on the side of the four-way switching valve 12, and the liquid-side closing valve 18*b* is disposed on the side of the heat source side expansion valves 14. These closing valves 18*a*, 18*b* are opened after the heat source unit 2 and the room units 3 are installed in the building and the refrigerant communication tubes 17*a*, 17*b* are connected to the closing valves 18*a*, 18*b*, respectively.

Figure 3:
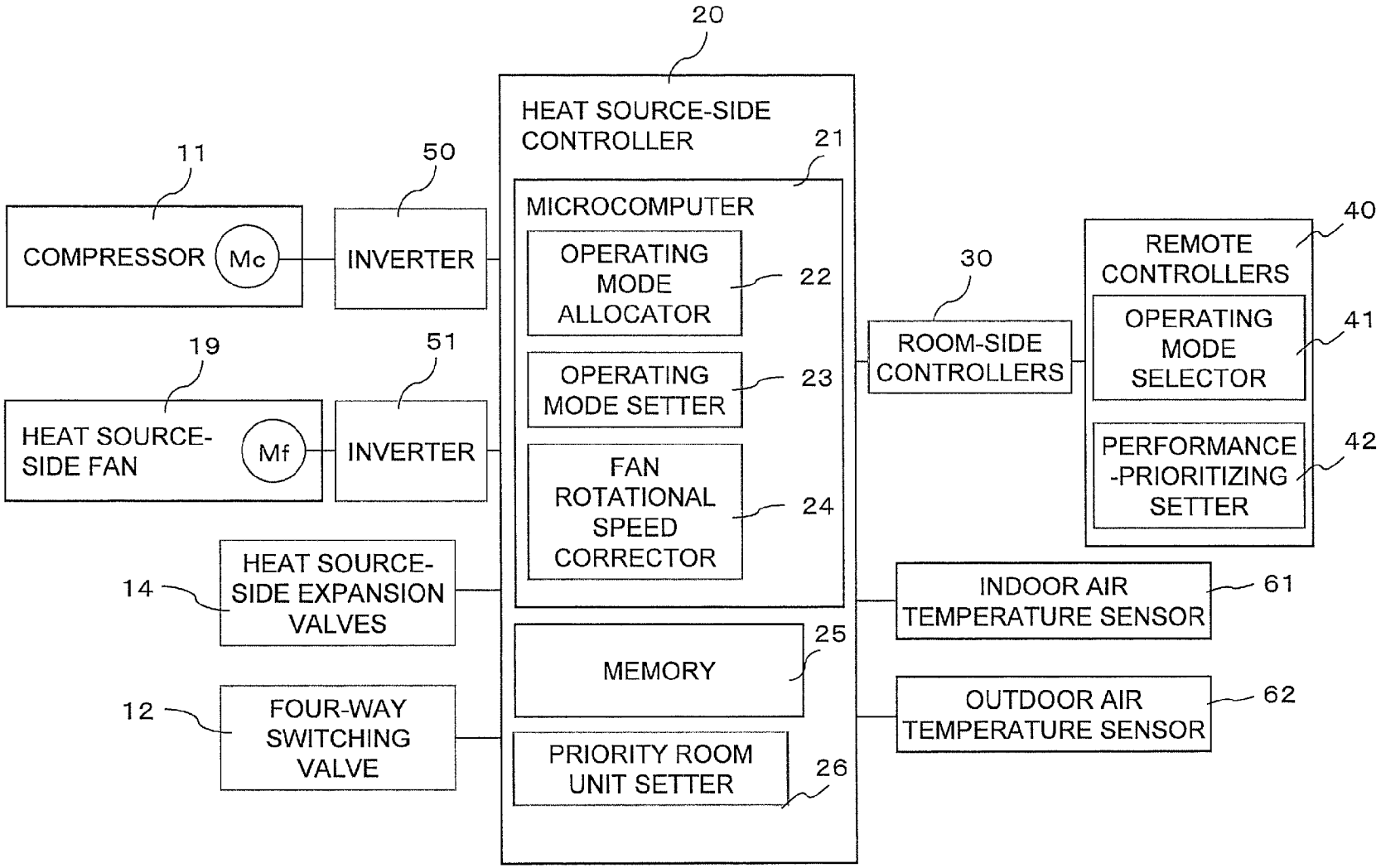
FIG. 3 is a diagram showing the configuration of the heat source side controller.

The compressor 11 is a variable-capacitance inverter compressor, and the operating frequency of a motor Mc for driving the compressor 11 is controlled by an inverter 50 (see FIG. 3).

A heat source side fan 19 is provided to the heat source unit 2. The heat source side fan 19 draws outdoor air into the casing of the heat source unit 2 by rotating, induces heat exchange in the heat source side heat exchanger 13 by blowing the suctioned air into the heat source side heat exchanger 13, and blows the air after heat exchange out of the casing of the heat source unit 2. The heat source side fan 19 is driven by a motor Mf controlled by an inverter 51 (see FIG. 3).

An outdoor air temperature sensor 62 for sensing the temperature of the outdoor air (specifically, the outdoor air temperature Ta) flowing into the heat source unit 2 is installed in the casing of the heat source unit 2, and indoor air temperature sensors 61 for sensing the temperature of the indoor air (specifically, the indoor temperature Tr) flowing into the room units 3 are installed in the casings of the room units 3.

A heat source side controller 20 is provided in the casing of the heat source unit 2, and a room side controller 30 connected to the heat source side controller 20 is provided in each of the casings of the room units 3. The heat source side controller 20 is disposed in an electric component box (not shown) disposed in the casing of the heat source unit 2. The heat source side controller 20 controls the electrical devices 11, 12, 14, 19, and other devices contained in the heat source unit 2 while communicating with the room side controllers 30, and the room side controllers 30 control the electrical devices contained in the room units 3 while communicating with the heat source side controller 20. The room side controllers 30 are capable of communicating with remote controllers 40 that users in the rooms Ri (I=1, 2, . . . , n) can use to separately operate the room units 3 in the rooms Ri.

(2) Operating Action

Next, the operating action of the air conditioner 1 will be described.

First, during the cooling operation, the four-way switching valve 12 is held in the state shown by the solid lines in FIG. 2. A high-temperature, high-pressure gas refrigerant discharged from the compressor 11 flows through the four-way switching valve 12 into the heat source side heat exchanger 13, where heat is exchanged with the outdoor air and the refrigerant is condensed. The refrigerant condensed into a liquid in the heat source side heat exchanger 13 passes through the heat source side expansion valves 14 and flows through the liquid refrigerant communication tubes 17*b* into the room units 3. In the room units 3, the refrigerant undergoes heat exchange with the indoor air in the room side heat exchangers 16 and evaporates. The indoor air cooled by the evaporation of the refrigerant is blown into the rooms by room side fans (not shown), and the rooms are cooled. The refrigerant evaporated to a gas in the room side heat exchangers 16 returns to the heat source unit 2 through the gas refrigerant communication tubes 17*a* and is drawn into the compressor 11.

During the heating operation, the four-way switching valve 12 is held in the state shown by the dashed lines in FIG. 2. A high-temperature, high-pressure gas refrigerant discharged from the compressor 11 flows through the four-way switching valve 12 into the room side heat exchangers 16 of the room units 3, where heat is exchanged with the indoor air and the refrigerant is condensed. The indoor air heated by the condensation of the refrigerant is blown out into the rooms by the room side fans, and the rooms are heated. The refrigerant condensed into a liquid in the room side heat exchangers 16 passes through the heat source side expansion valves 14 via the liquid refrigerant communication tubes 17*b*, and returns to the heat source unit 2. Having returned to the heat source unit 2, the refrigerant undergoes further heat exchange with the outdoor air in the heat source side heat exchanger 13 and is evaporated. The refrigerant evaporated to a gas in the heat source side heat exchanger 13 is drawn into the compressor 11 via the four-way switching valve 12.

<Heat Source Side Controller>

(1) Overall Configuration

The configuration of the heat source side controller 20 will be described with reference to FIG. 3.

The heat source side controller 20 is a control circuit having a microcomputer 21 and a memory 25, and the heat source side controller 20 controls the compressor 11, the four-way switching valve 12, the heat source side expansion valves 14, the heat source side fan 19, and the various other electric devices included in the heat source unit 2 by reading and executing the programs stored in the memory 25 on the microcomputer 21.

The heat source side controller 20 can receive information pertaining to the outdoor air temperature Ta sensed in the outdoor air temperature sensor 62, and can also receive the indoor temperature Tr sensed in the indoor air temperature sensor 61 via the room side controllers 30. The heat source side controller 20 can also receive operation information in the room units 3 via the room side controllers 30. The operation information mentioned herein includes state information pertaining to the operating states of the components of the room side controllers 30, setting information pertaining to the operational settings inputted from users via the remote controllers 40, and other such information. The various electric devices 11, 12, 14, 19, and the like are controlled by the heat source side controller 20 on the basis of this information.

The heat source side controller 20 controls the compressor 11 by controlling the motor Mc via the inverter 50, and also controls the heat source side fan 19 by controlling the motor Mf via the inverter 51. The inverters 50, 51 are disposed in an electric component box (not shown) that houses the heat source side controller 20.

The heat source side controller 20 is also provided with a priority room unit setter 26 in the form of a DIP switch. The priority room unit setter 26 accepts priority settings for prioritizing one room wait 3 from among all the room units 3 over the other room units 3. For example, when a user wishes to enable a priority setting, the user informs a coordinator. Having received this request, the coordinator goes to the user's residence and operates the DIP switch on the control circuit of the heat source unit 2, whereby one arbitrary room unit 3 can be given a priority setting.

(2) Noise-Reduction Operating Modes I to III

The heat source unit 2 is provided with three noise-reduction operating modes I to III whose noise-reduction levels are higher than in regular operating mode. Noise-reduction operating mode II has a higher noise-reduction level than noise-reduction operating mode I, and noise-reduction operating mode III has a higher noise-reduction level than noise-reduction operating mode II. In noise-reduction operating modes I to III, restrictions are imposed on the upper limit Lc of the operating frequency of the compressor 11 and on the upper limit Lf of the rotational speed of the heat source side fan 19, whereby the operating sounds of the compressor 11 and the heat source side fan 19 are suppressed.

FIG. 4 shows the details of the restrictions on the upper limits Lc, Lf in the three noise-reduction operating modes I to III. Specifically, in noise-reduction operating mode I, the upper limit Lc of the operating frequency of the compressor 11 and the upper limit Lf of the rotational speed of the heat source side fan 19 are set close to rated speeds. In noise-reduction operating mode II, the upper limit Lc of the operating frequency of the compressor 11 and the upper limit Lf of the rotational speed of the heat source side fan 19 are set to be lower than in regular operating mode by a specific amount (equivalent to 3 dB (decibels) in the present embodiment). In noise-reduction operating mode III, the upper limit Lc of the operating frequency of the compressor 11 and the upper limit Lf of the rotational speed of the heat source side fan 19 are set to be lower than in regular operating mode by a specific amount (equivalent to 5 dB (decibels) in the present embodiment). Thereby, in noise-reduction operating mode II, the operating sounds can be reduced on average by approximately 3 dB less than in regular operating mode, and in noise-reduction operating mode III, the operating sounds can be reduced on average by approximately 5 dB less than in regular operating mode. In noise-reduction operating mode I, the operating sounds are lower than in regular operating mode, and the air conditioning performance of the air conditioner 1 is kept to a minimum.

(3) Process for Determining Operating Mode

The heat source unit 2 operates in any one operating mode from among a total of four operating modes, including one regular operating mode and three noise-reduction operating modes I to III. The heat source side controller 20 performs the process of determining which operating mode of these four operating modes will be used by the heat source unit 2.

Figure 5:
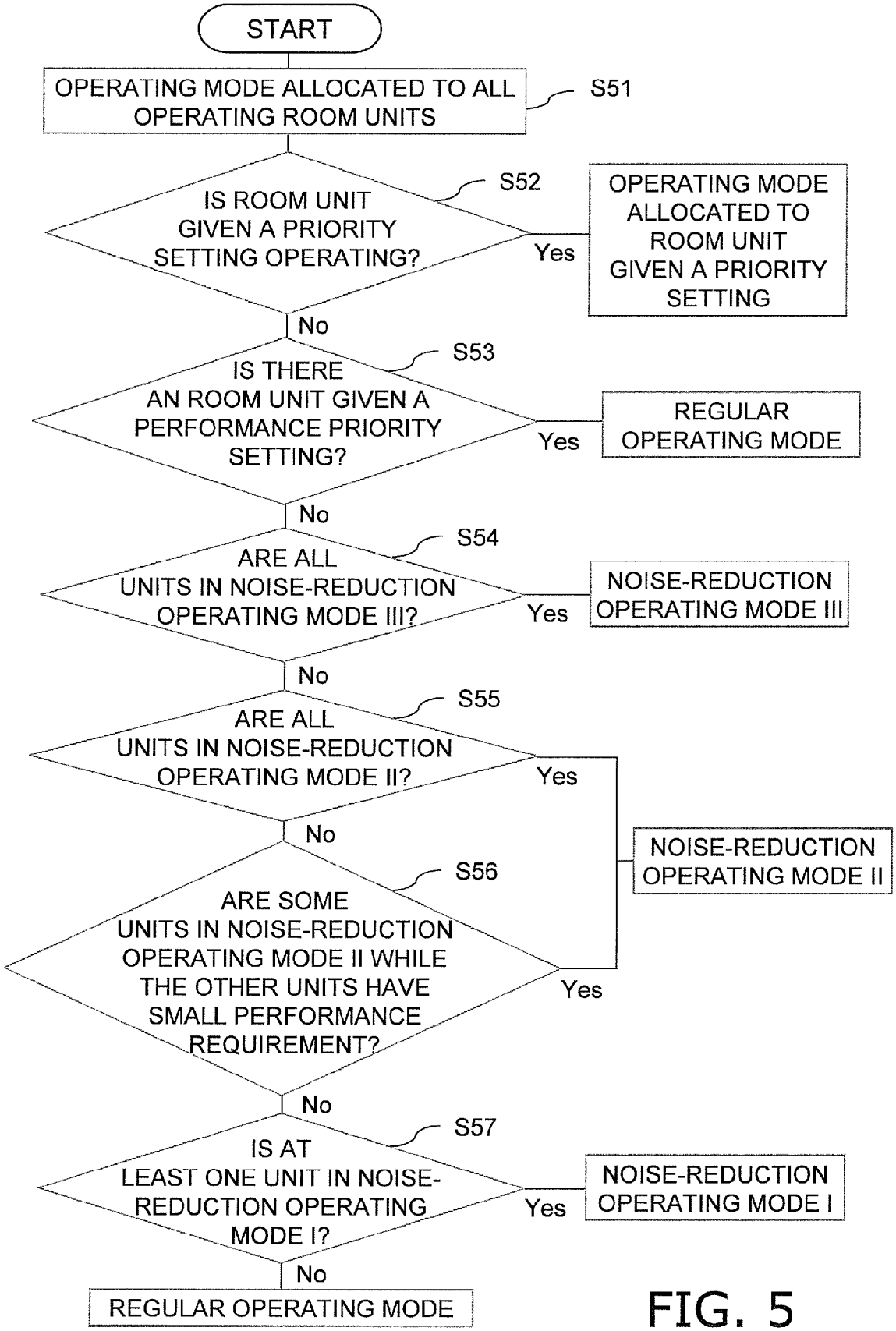
FIG. 5 is a flowchart showing the process for determining one operating mode to be used by the heat source unit from among four operating modes.

The following is a detailed description, made with reference to FIG. 5, of the manner in which the heat source side controller 20 determines which operating mode of the four operating modes will be used by the heat source unit 2.

The process according to the flowchart in FIG. 5 begins either when a power source is initially applied to any of the room units 3 connected to the heat source unit 2 (specifically, when the operation of the air conditioner 1 is initiated), or when a signal (hereinbelow, the operating mode selection signal) for selecting one operating mode from among the four operating modes described above is sent to the heat source side controller 20 from any of the operating room units 3. This operating mode selection signal is created when one operating mode from among the four operating modes is selected by a user in a room Ri (i=1, 2, . . . , n) via the remote controller 40 placed in that room Ri, and the signal is immediately sent to the heat source side controller 20 via the room side controller 30 of the room unit 3 installed in that room Ri. The operating mode selection signal is "1" when noise-reduction operating mode I is selected by the user, "2" when noise-reduction operating mode II is selected by the user, and "3" when noise-reduction operating mode III is selected by the user. At this time, the remote controller 40 acts as an operating mode selector 41 which allows the user to select one operating mode from among the four operating modes via the room unit 3. The user can select one operating mode from among the four operating modes via the remote controller 40 placed in the room Ri at any time the room unit 3 in the room Ri is operating.

In step S51, the heat source side controller 20 acts as an operating mode allocator 22. The operating mode allocator 22 allocates one operating mode from among the four operating modes to each of the operating room units 3 from among all of the room units 3 installed in all of the rooms R1, 2, . . . , Rn in the residential building 100. At this time, the operating mode indicated by the operating mode selection signal is allocated to the room units 3 of the rooms Ri to which the operating mode selection signal is sent, and regular operating mode is allocated to the room units 3 of the rooms Ri to which the operating mode selection signal is not sent.

Next, the heat source side controller 20 acts as an operating mode setter 23 in step S52. First, the operating mode setter 23 determines whether or not the room unit 3 given a priority setting via the priority room unit setter 26 is operating. In cases in which it is determined that this condition is satisfied, the operating mode allocated to the room unit 3 given a priority setting is set as the operating mode to be used by the heat source unit 2, and the flow ends. In cases in which it is determined that this condition is not satisfied, the flow advances to step S53.

In step S53, the operating mode setter 23 determines whether or not there is a room unit 3 among all of the operating room units 3 that have been given a performance priority setting. In cases in which it is determined that this condition is satisfied, regular operating mode is set as the operating mode to be used by the heat source unit 2, and the flow ends. In cases in which it is determined that this condition is not satisfied, the flow advances to step S54. The term "performance priority setting" refers to a setting which suppresses operation in noise-reduction operating modes I to III and allows only operation in regular operating mode, and the details of this setting are described hereinafter.

In step S54, the operating mode setter 23 determines whether or not noise-reduction operating mode III has been allocated to all of the operating room units 3. In cases in which it is determined that this condition is satisfied, noise-reduction operating mode III is set as the operating mode to be used by the heat source unit 2, and the flow ends. In cases in which it is determined that this condition is not satisfied, the flow advances to step S55.

In step S55, the operating mode setter 23 determines whether or not noise-reduction operating mode II has been allocated to all of the operating room units 3. In cases in which it is determined that this condition is satisfied, noise-reduction operating mode II is set as the operating mode to be used by the heat source unit 2, and the flow ends. In cases in which it is determined that this condition is not satisfied, the flow advances to step S56.

In step S56, the operating mode setter 23 determines whether or not noise-reduction operating mode II has been allocated to at least one of the operating room units 3, and whether or not performance less than a specific value is required in all of the rooms Ri in which the remaining room units 3 not allocated noise-reduction operating mode II from among the operating room units 3 are installed. In cases in which it is determined that both of these conditions are satisfied, noise-reduction operating mode II is set as the operating mode to be used by the heat source unit 2, and the flow ends. In cases in which it is determined that at least one of these conditions is not satisfied, the flow advances to step S57. The term "performance required in the room Ri" refers to the difference between the set temperature that is set for the room unit 3 installed in the room Ri, and the current indoor temperature Tr. When this performance is calculated, the indoor temperature Tr sensed by the indoor air temperature sensor 61 is used.

In step S57, the operating mode setter 23 determines whether or not any of the noise-reduction operating modes I to III have been allocated to at least one of the operating room units 3. In cases in which it is determined that this condition is satisfied, noise-reduction operating mode I is set as the operating mode to be used by the heat source unit 2, and the flow ends. In cases in which it is determined that this condition is not satisfied, regular operating mode is set as the operating mode to be used by the heat source unit 2, and the flow ends.

Figure 6:
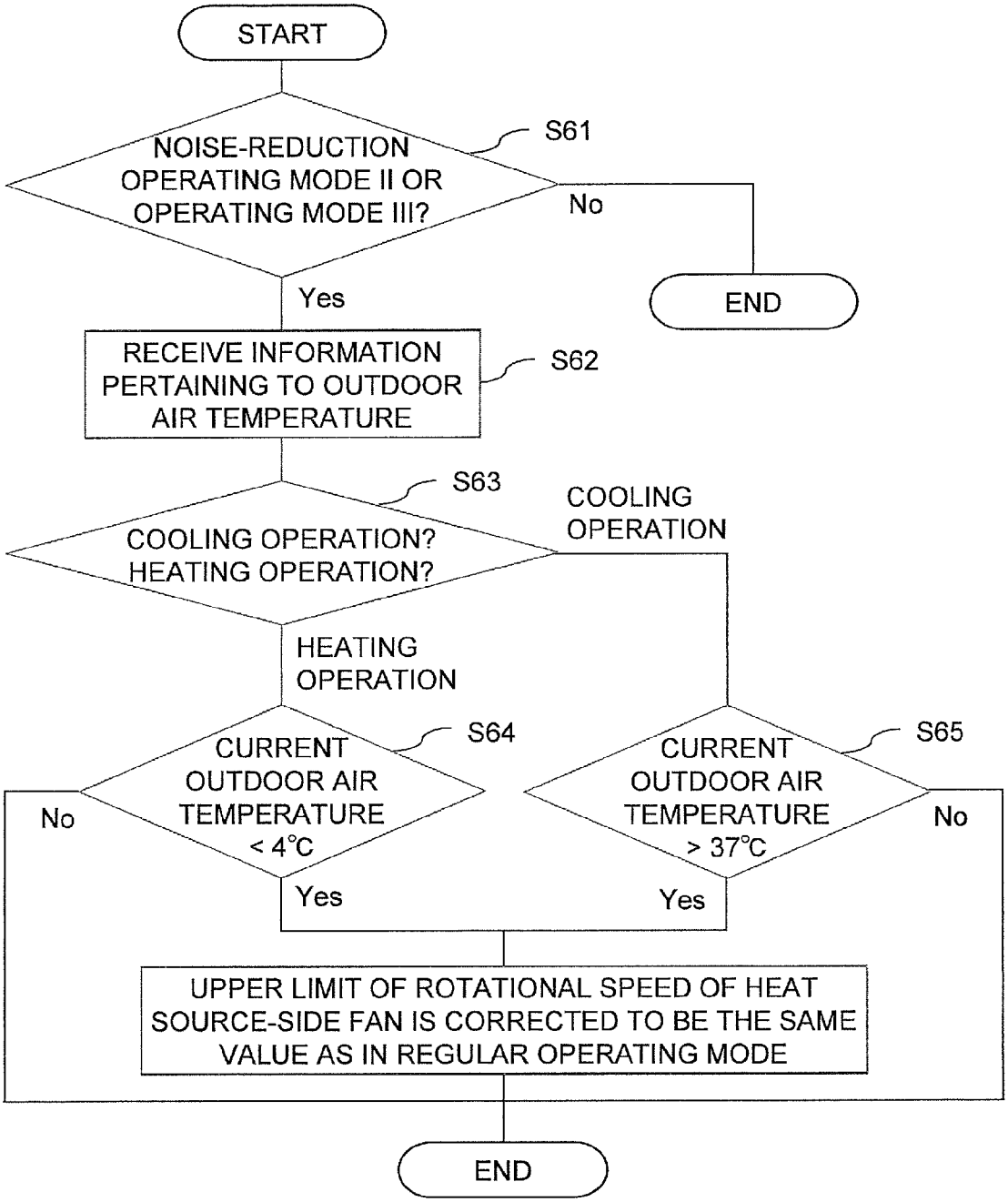
FIG. 6 is a flowchart showing the process for correcting the upper limit of the rotational speed of the heat source side fan.

(4) Process of Correcting the Upper Limit Lf of the Rotational Speed of the Heat Source Side Fan While the air conditioner 1 is operating, the heat source side controller 20 repeats the process according to the flowchart in FIG. 6 at specific time intervals. At this time, the heat source side controller 20 acts as a fan rotational speed corrector 24. The process according to the flowchart in FIG. 6 can be performed in parallel with the process according to the flowchart in FIG. 5 by the heat source side controller 20.

In step S61, the fan rotational speed corrector 24 determines whether or not the heat source unit 2 is operating in noise-reduction operating mode II or III. In cases in which the heat source unit 2 is determined to be thus operating, the flow advances to step S62, and in cases in which the heat source unit 2 is not determined to be thus operating, the flow ends.

In step S62, the fan rotational speed corrector 24 receives information pertaining to the outdoor air temperature Ta sensed in the outdoor air temperature sensor 62.

Next, in step S63, the fan rotational speed corrector 24 determines whether the heat source unit is performing the heating operation or the cooling operation. In cases in which it is determined to be performing the heating operation, the flow advances to step S64, and in cases in which it is determined to be performing the cooling operation, the flow advances to step S65.

In step S64, the fan rotational speed corrector 24 determines whether or not the current outdoor air temperature Ta is less than a first temperature (4° C. in the present embodiment) on the basis of the information pertaining to the outdoor air temperature Ta received in step S62. In cases in which the current outdoor air temperature Ta is determined to be lower than the first temperature, the upper limit Lf of the rotational speed of the heat source side fan 19 is corrected so as to be the same value as in regular operating mode, and the flow ends. Generally, in cases in which noise-reduction operating mode II or III is used during the heating operation under low outdoor air temperature conditions, the amount of frost deposition in the heat source side heat exchanger 13 increases because the rotational speed of the heat source side fan 19 is reduced, and the problem of reduced heating performance is sometimes encountered. However, such problems are prevented by step S64.

In step S65, the fan rotational speed corrector 24 determines whether or not the current outdoor air temperature Ta is higher than a second temperature (37° C. in the present embodiment) which is higher than the first temperature. The determination is made on the basis of the information pertaining to the outdoor air temperature Ta received in step S62. In cases in which the current outdoor air temperature Ta is determined to be higher than the second temperature, the upper limit Lf of the rotational speed of the heat source side fan 19 is corrected so as to be the same value as in regular operating mode, and the flow ends. Generally, in cases in which noise-reduction operating mode II or III is used during the cooling operation under high outdoor air temperature conditions, a problem is sometimes encountered in which the electric components in the electric component box in the heat source unit 2 are not sufficiently cooled because the rotational speed of the heat source side fan 19 is reduced. However, such problems are prevented by step S65.

(5) Process when Performance Priority Setting is Selected

Since the air conditioning performance of the air conditioner 1 decreases somewhat when noise-reduction operating modes I to III are used, the user can enable a performance priority setting, prohibiting operation in noise-reduction operating modes I to III and allowing only operation in regular operating mode. When the user enables the performance priority setting, a command to enable the performance priority setting is inputted to the remote controller 40 of the room unit 3 installed in the room Ri where the setting is desired. At this time, the remote controller 40 acts as a performance priority setter 42. The performance priority setter 42 then immediately sends a signal instructing the performance priority setting to be enabled to the heat source side controller 20. The heat source side controller 20 acts as the operating mode setter 23 when the signal is received. At this time, the operating mode setter 23 creates a list of the room units 3 given the performance priority setting, and stores the list in the memory 25. By referring to the list stored in the memory 25, the operating mode setter 23 can determine whether or not there is a room unit 3 that has been given the performance priority setting in step S53 described above. Upon receiving the signal instructing the performance priority setting to be enabled, the operating mode setter 23 immediately determines whether or not the heat source unit 2 is not operating in any of the noise-reduction operating modes I to III. When the unit is determined to be operating in any of the noise-reduction operating modes I to III, the current operating mode is switched to regular operating mode.

This performance priority setting can also be deactivated. At this time, the user inputs a command for deactivating the performance priority setting to the performance priority setter 42 of the room unit 3 installed in the room Ri where the user desired to deactivate the setting. The performance priority setter 42 then immediately sends a signal instructing the performance priority setting to be deactivated to the heat source side controller 20. The operating mode setter 23 deletes that room unit 3 from the list of room units 3 given the performance priority setting stored in the memory 25, then performs the same process as the process according to the flowchart in FIG. 5, and considers which operating mode is optimal under the current conditions.

<Characteristics>

(1)

In the multi-room air conditioner, since a plurality of room units is connected to one heat source unit, the operating frequency of the compressor and the rotational speed of the heat source side fan increase, and operating sounds are likely to be greater than in a single-type air conditioner. However, when an excessive restriction is imposed as a noise countermeasure on the upper limit of the operating frequency of the compressor and on the upper limit of the rotational speed of the heat source side fan, the performance of the air conditioner could be compromised.

In view of this, with the air conditioner 1, the requirements of the users for the rooms Ri (1, 2, . . . , n) are collected by the heat source side controller 20 via the remote controllers 40, and these requirements are adjusted in the heat source side controller 20. It is therefore possible to achieve two objectives in a tradeoff relationship between prioritizing performance and prioritizing noise reduction.

(2)

In the present embodiment, a signal "1" is created when noise-reduction operating mode I is selected by the user via the remote controller 40, a signal "2" is created when noise-reduction operating mode II is selected, and a signal "3" is created when noise-reduction operating mode III is selected. These created signals are sent immediately to the heat source unit 2 from the room units 3. Thus, signals that are exchanged between the room units 3 and the heat source unit 2 and that indicate requirements for the units are limited to three types, which is the same number as the number of types of noise-reduction operating modes. The single operating mode to be set is determined by taking into account a maximum of four types of information, which are obtained by adding one type of signal that corresponds to the regular operating mode to the aforementioned three types, for each of the room units 3 currently in operation. Therefore, the computational load on the heat source side controller 20 is also very small.

<Modifications>

(1)

The location where the air conditioner 1 is installed is not limited to a residential building 100, and may be another type of building in which a plurality of spaces is to be air conditioned.

(2)

The compressor 11 may be a combination of an arbitrary number of inverter compressors and constant-capacity compressors in which on-off control is enabled.

(3)

In step S64 described above, instead of setting the upper limit Lf of the rotational speed of the heat source side fan 19 to the same value as in regular operating mode, the upper limit Lf may be corrected so as to increase by a specific amount or by a specific percentage, or the noise-reduction level may be lowered one level. Information pertaining to the specific amount or specific percentage used at this time may be stored in advance in the memory 25, for example. The same applies to correcting the upper limit Lf in step S65.

(4)

The noise-reduction operating modes I to III, whose details are shown in FIG. 4, may be designed as follows. Specifically, in noise-reduction operating mode I, the upper limit Lc of the operating frequency of the compressor 11 and the upper limit Lf of the rotational speed of the heat source side fan 19 are set close to rated speeds. In noise-reduction operating mode II, the upper limits Lc, Lf are both set to be lower than in noise-reduction operating mode I by a specific percentage (for example, 10% to 30%). In noise-reduction operating mode III, the upper limits Lc, Lf are both set to be lower than in noise-reduction operating mode II by a specific percentage (for example, 10% to 30%). Furthermore, in this case, the upper limits Lc, Lf may be set according to the total capacity of the operating room units 3, and the value of the specific percentage, which is a parameter for setting the upper limits Lc, Lf in noise-reduction operating modes II and III, for example, may vary according to the total capacity of the operating room units 3.

INDUSTRIAL APPLICABILITY

The present invention provides a multi-room air conditioner having a heat source unit that can be switched among a plurality of operating modes having different noise-reduction levels. The present invention has the effect of making it possible to adjust requirements from different rooms when one operating mode is selected from among a plurality of operating modes, and to achieve an optimal noise-reduction operation. The present invention is effective as a control apparatus and a control method for a multi-room air conditioner having a heat source unit that can be switched among a plurality of operating modes having different noise-reduction levels.

What is claimed is:

1. A control apparatus for a multi-room air conditioner having a heat source unit being configured to be switched among a plurality of operating modes having different noise-reduction levels, and a plurality of conditioning units being connected to the heat source unit via a refrigerant communication tube and distributed among a plurality of rooms, the control apparatus for the multi-room air conditioner comprising:

an operating mode allocator being configured to allocate one operating mode from among the plurality of operating modes to each of the operating conditioning units of the plurality of conditioning units; and an operating mode setter being configured to set the heat source unit to one operating mode from among the plurality of operating modes on the basis of the operating modes allocated by the operating mode allocator to each of the operating conditioning units, the plurality of operating modes including a first operating mode and a second operating mode in which the noise reduction level is higher than in the first operating mode, under a first condition in which a specific operating mode from among the plurality of operating modes is allocated to all of the operating conditioning units, the operating mode setter setting the heat source unit to the specific operating mode, and under a second condition in which the second operating mode is allocated to at least one of the operating conditioning units, and the performance required in the operating conditioning units is less than a specific level, the operating mode setter setting the heat source unit to an operating mode in which the noise-reduction level is higher than in the first operating mode.

2. The control apparatus for the multi-room air conditioner as recited in claim 1, wherein the plurality of operating modes further includes a regular operating mode, with the first and second operating modes having higher noise-reduction levels.

3. The control apparatus for the multi-room air conditioner as recited in claim 2, wherein the multi-room air conditioner further has an operating mode selector allowing the user to select one operating mode from among the plurality of operating modes via the operating conditioning units, and the operating mode allocator allocates one operating mode from among the plurality of operating modes to each of the operating conditioning units on the basis of the operating mode selected by the user via the operating mode selector.

4. The control apparatus for the multi-room air conditioner as recited in claim 2, the heat source unit having a heat exchanger, and a heat source side fan to send air to the heat exchanger, wherein restrictions that differ according to the plurality of operating modes are imposed on the rotational speed of the heat source side fan.

5. The control apparatus for the multi-room air conditioner as recited in claim 4, wherein the heat source unit has a compressor, and restrictions that differ according to the plurality of operating modes are imposed on the operating frequency of the compressor.

6. The control apparatus for the multi-room air conditioner as recited in claim 2, wherein the heat source unit has a compressor, and restrictions that differ according to the plurality of operating modes are imposed on the operating frequency of the compressor.

7. The control apparatus for the multi-room air conditioner as recited in claim 2, wherein the multi-room air conditioner further has a performance priority setter configured to accept settings prioritizing that performance will be ensured in at least one of the plurality of conditioning units, and the operating mode setter sets the heat source unit to the regular operating mode under a third condition in which a conditioning unit given a priority setting via the performance priority setter is operating.

8. The control apparatus for the multi-room air conditioner as recited in claim 1, wherein the multi-room air conditioner further has an operating mode selector allowing the user to select one operating mode from among the plurality of operating modes via the operating conditioning units, and the operating mode allocator allocates one operating mode from among the plurality of operating modes to each of the operating conditioning units on the basis of the operating mode selected by the user via the operating mode selector.

9. The control apparatus for the multi-room air conditioner as recited in claim 1, wherein the multi-room air conditioner further has a priority conditioning unit setter configured to accept settings that prioritize any one of the plurality of conditioning units, and under a third condition in which a conditioning unit given a priority setting via the priority conditioning unit setter is operating, the operating mode setter sets the heat source unit to the operating mode allocated to that conditioning unit given the priority setting.

10. A control apparatus for a multi-room air conditioner having a heat source unit being configured to be switched among a plurality of operating modes having different noise-reduction levels, and a plurality of conditioning units being connected to the heat source unit via a refrigerant communication tube and distributed among a plurality of rooms; the control apparatus for the multi-room air conditioner comprising:

an operating mode allocator being configured to allocate one operating mode from among the plurality of operating modes to each of the operating conditioning units of the plurality of conditioning units; and an operating mode setter being configured to set the heat source unit to one operating mode from among the plurality of operating modes on the basis of the operating modes allocated by the operating mode allocator to each of the operating conditioning units, under a first condition in which a specific operating mode from among the plurality of operating modes is allocated to all of the operating conditioning units, the operating mode setter setting the heat source unit to the specific operating mode, the plurality of operating modes including a plurality of noise-reduction operating modes in which the noise-reduction levels are progressively higher, under a second condition in which a specific operating mode is allocated to at least one of the operating conditioning units, and all required performances of the rooms in which the remaining conditioning units of the operating conditioning units are installed are less than a specific value, the operating mode setter sets the heat source unit to the specific operating mode.

11. A control apparatus for a multi-room air conditioner having a heat source unit being configured to be switched among a plurality of operating modes having different noise-reduction levels, and a plurality of conditioning units being connected to the heat source unit via a refrigerant communication tube and distributed among a plurality of rooms; the control apparatus for the multi-room air conditioner comprising:

an operating mode allocator being configured to allocate one operating mode from among the plurality of operating modes to each of the operating conditioning units of the plurality of conditioning units; and an operating mode setter being configured n mode from among the plurality of operating modes on the basis of the operating modes allocated by the operating mode allocator to each of the operating conditioning units, under a first condition in which a specific operating mode from among the plurality of operating modes is allocated to all of the operating conditioning units, the operating mode setter setting the heat source unit to the specific operating mode, the plurality of operating modes including a plurality of noise-reduction operating modes in which the noise-reduction levels are progressively higher, under a second condition in which at least one of the operating conditioning units is allocated either a specific noise-reduction operating mode from among the plurality of noise-reduction operating modes or a noise-reduction operating mode having a higher noise-reduction level than the specific noise-reduction operating mode, the operating mode setter does not set the heat source unit to an operating mode having a lower noise-reduction level than the specific noise-reduction operating mode.

12. A control apparatus for a multi-room air conditioner having a heat source unit being configured to be switched among a plurality of operating modes having different noise-reduction levels, and a plurality of conditioning units being connected to the heat source unit via a refrigerant communication tube and distributed among a plurality of rooms; the control apparatus for the multi-room air conditioner comprising:

an operating mode allocator being configured to allocate one operating mode from among the plurality of operating modes to each of the operating conditioning units of the plurality of conditioning units;

an operating mode setter being configured to set the heat source unit to one operating mode from among the plurality of operating modes on the basis of the operating modes allocated by the operating allocator to each of the operating conditioning units; and a priority conditioning unit setter configured to accept settings that prioritize any one of the plurality of conditioning units, under a first condition in which a specific operating mode from among the plurality of operating modes is allocated to all of the operating conditioning units, the operating mode setter setting the heat source unit to the specific operating mode, the plurality of operating modes including a plurality of noise-reduction operating modes in which the noise-reduction levels are progressively higher, and under a second condition in which a conditioning unit given a priority setting via the priority conditioning unit setter is operating, the operating mode setter sets the heat source unit to the operating mode allocated to that conditioning unit given the priority setting.

13. A control apparatus for a multi-room air conditioner having a heat source unit being configured to be switched among a plurality of operating modes having different noise-reduction levels, and a plurality of conditioning units being connected to the heat source unit via a refrigerant communication tube and distributed among a plurality of rooms; the control apparatus for the multi-room air conditioner comprising:

an operating mode allocator being configured to allocate one operating mode from among the plurality of operating modes to each of the operating conditioning units of the plurality of conditioning units;

an operating mode setter being configured to set the heat source unit to one operating mode from among the plurality of operating modes on the basis of the operating modes allocated by the operating mode allocator to each of the operating conditioning units; and a performance priority setter configured to accept settings prioritizing that performance will be ensured in at least one of the plurality of conditioning units, under a first condition in which a specific operating mode from among the plurality of operating modes is allocated to all of the operating conditioning units, the operating mode setter setting the heat source unit to the specific operating mode, the plurality of operating modes including a regular operating mode, and a plurality of noise-reduction operating modes in which the noise-reduction levels are progressively higher than in the regular operating mode, and the operating mode setter setting the heat source unit to the regular operating mode under a second condition in which a conditioning unit given a priority setting via the performance priority setter is operating.

14. A control apparatus for a multi-room air conditioner having a heat source unit being configured to be switched among a plurality of operating modes having different noise-reduction levels, and a plurality of conditioning units being connected to the heat source unit via a refrigerant communication tube and distributed among a plurality of rooms; the control apparatus for the multi-room air conditioner comprising:

an operating mode allocator being configured to allocate one operating mode from among the plurality of operating modes to each of the operating conditioning units of the plurality of conditioning units;

an operating mode setter being configured to set the heat source unit to one operating mode from among the plurality of operating modes on the basis of the operating modes allocated by the operating mode allocator to each of the operating conditioning units;

a fan rotational speed corrector; and an outdoor air temperature detection unit that detects an outdoor air temperature, under a first condition in which a specific operating mode from among the plurality of operating modes is allocated to all of the operating conditioning units, the operating mode setter setting the heat source unit to the specific operating mode, the plurality of operating modes including a plurality of noise-reduction operating modes in which the noise-reduction levels are progressively higher, the heat source unit having a heat exchanger and a heat source side fan to send air to the heat exchanger, with restrictions that differ according to the plurality of operating modes being imposed on the rotational speed of the heat source side fan, and the fan rotational speed corrector performing a correction so as to increase the rotational speed of the heat source side fan of the heat source unit operating in the noise-reduction operating mode in cases in which the outdoor air temperature detected by the outdoor air temperature detection unit satisfies a specific condition.

15. The control apparatus for the multi-room air conditioner as recited in claim 14, wherein the fan rotational speed corrector increases the rotational speed of the heat source side fan in cases in which the outdoor air temperature detected by the outdoor air temperature detection unit is less than a first temperature during the heating operation, or greater than a second temperature above the first temperature during the cooling operation.

16. A control method for a multi-room air conditioner having a heat source unit being configured to be switched among a plurality of operating modes having different noise-reduction levels, and a plurality of conditioning units connected to the heat source unit via a refrigerant communication tube and distributed among a plurality of rooms, the control method for the multi-room air conditioner comprising:

allocating one operating mode from among the plurality of operating modes to each of the operating conditioning units of the plurality of conditioning units, the plurality of operating modes including a first operating mode and a second operating mode in which the noise reduction level is higher than in the first operating mode; and setting the heat source unit to one operating mode of the plurality of operating modes on the basis of the operating modes allocated to each of the operating conditioning units, while setting the heat source unit, under a first condition in which a specific one operating mode from among the plurality of operating modes is allocated to all of the operating conditioning units, the heat source unit is set to the specific one operating mode, and while setting the heat source unit, under a second condition in which the second operating mode is allocated to at least one of the operating conditioning units, and the performance required in the operating conditioning units is less than a specific level, the heat source unit is set to an operating mode in which the noise-reduction level is higher than in the first operating mode.

* * * * *